US007387381B2

(12) United States Patent
Katoh et al.

(10) Patent No.: US 7,387,381 B2
(45) Date of Patent: Jun. 17, 2008

(54) INK JET RECORDING SHEET AND IMAGE FORMING METHOD

(75) Inventors: Eisaku Katoh, Hachioji (JP); Atsushi Tomotake, Hino (JP); Masayuki Ushiku, Yokohama (JP)

(73) Assignee: Konica Corporation, Tokyo (JP)

( * ) Notice: Subject to any disclaimer, the term of this patent is extended or adjusted under 35 U.S.C. 154(b) by 38 days.

(21) Appl. No.: 10/655,104

(22) Filed: Sep. 3, 2003

(65) Prior Publication Data

US 2004/0048007 A1 Mar. 11, 2004

(30) Foreign Application Priority Data

Sep. 10, 2002 (JP) ..... 2002-263870

(51) Int. Cl.
*B41J 2/01* (2006.01)
*B41M 5/40* (2006.01)

(52) U.S. Cl. ..... 347/105; 428/32.3; 428/32.34

(58) Field of Classification Search ..... 428/32.15, 428/32.26, 32.29, 32.3
See application file for complete search history.

(56) References Cited

U.S. PATENT DOCUMENTS 4,554,181 A * 11/1985 Cousin et al. ..... 428/32.3
5,853,540 A * 12/1998 Niemoller et al. ..... 428/32.21
6,464,351 B1 * 10/2002 Landry-Coltrain et al. . 347/105
6,616,991 B1 * 9/2003 Uto ..... 428/32.24
2001/0021439 A1 * 9/2001 Sumita et al. ..... 428/195
2003/0152752 A1 * 8/2003 Tokiyoshi et al. ..... 428/195

FOREIGN PATENT DOCUMENTS

| | | |
|---|---|---|
| DE | 195 34 327 A1 | 2/1996 |
| EP | 0 487 350 A1 | 5/1992 |
| EP | 0 582 466 A1 | 2/1994 |
| EP | 0 770 493 A1 | 5/1997 |
| JP | 11-99742 | 4/1999 |
| JP | 11-165460 | 6/1999 |
| JP | 2000-177234 | 6/2000 |
| JP | 2000-238407 | 9/2000 |
| JP | 2001-205929 | 7/2001 |
| WO | WO 00/41890 A1 | 7/2000 |

OTHER PUBLICATIONS

Derwent Publications Ltd., London, GB; Database WPI, Section CH, Week 199027, AN 1990-205574; XP002263154 of JP 02 136279 A (Oji Paper Co.), May 24, 1990.

* cited by examiner

*Primary Examiner*—Pamela R Schwartz
(74) *Attorney, Agent, or Firm*—Frishauf, Holtz, Goodman & Chick, P.C.

(57) ABSTRACT

An ink jet recording sheet having a porous ink receiving layer is disclosed. The porous ink receiving layer contains a compound which has a plural number of non-aromatic carbon-carbon unsaturated bonds in a molecule, inorganic particles and a hydrophilic binder. An image forming method employing the ink jet recording sheet and a water-base ink is also disclosed.

8 Claims, No Drawings

INK JET RECORDING SHEET AND IMAGE FORMING METHOD

FIELD OF THE INVENTION

The present invention relates to an ink jet recording sheet suitable for water-based dye ink, and particularly to an ink jet recording sheet suitable for water-based dye ink, which exhibits superior ink absorbability, high image visibility, capability of recording high image quality comparable to photographic images, as well as excellent storage stability. Further, this invention relates to an image forming method employing the ink jet recording sheet and water-based dye ink to obtain an ink image which exhibits high image visibility, high image quality comparable to photographic images, as well as excellent image storage stability.

BACKGROUND OF THE INVENTION

In recent years, image quality of ink jet recording materials has been rapidly improved to approach photographic image quality. Particularly, to achieve image quality comparable to photographic image quality via ink jet recording, improvement also with respect to an ink jet recording sheet (hereinafter, also simply referred to as a recording sheet) has also progressed, and a porous-type recording sheet, in which a tiny pore layer comprised of inorganic particles and a hydrophilic polymer is provided on a very smooth support, is becoming a recording medium resulting in the nearest photographic image quality, since it exhibits high gloss, vivid coloration, as well as excellent ink absorbability and drying characteristics. Particularly, when a non-water absorbing support is utilized, cockle after printing, so-called "wrinkles", which are often observed with a water absorbing support, are not generated and a very smooth surface is maintained to result in a higher quality print.

Ink jet recording is generally classified into one which utilizes water-based ink using water and a water-soluble solvent as an ink solvent and one which utilizes a non-water based oil solvent, and each of these comprises a type which utilizes a dye as a colorant and a type which utilizes a pigment, which require an exclusive sheet suitable for each type to result in high quality images. As for ink, water-based ink with less environmental load and greater safety aspects has prevailed.

Among water-based inks, pigment ink exhibits high image durability, however, it is tends to vary gloss image-wise, rarely resulting in print quality similar to photographic images; on the other hand, in case of utilizing water-soluble dye ink, a color print comparable to a photographic image having high image visibility as well as uniform surface gloss can be obtained relatively easily.

However, in contrast to the water-soluble dye which provides images of high quality, it has been a problem in that image stability is poor compared to a pigment ink and exhibits significant fading by sunlight or even room-light, and also fading by such an oxidizing gas such as ozone present in ambient air. Particularly, a porous-type recording sheet provided with a tiny pore layer is sensitive to ambient oxidizing gas because the contact area between a dye and the air in a room is increased, and improvement has been desired.

In order to overcome such deterioration due to storage, many proposals have been made such as various kinds of anti-oxidants as anti-fading agents being added.

For example, an ink jet recording sheet including various kinds of compounds as anti-oxidants is described in JP-A Nos. 57-87989, 57-74192 and 60-72785; an ink jet recording sheet in which an UV absorbent is incorporated in JP-A No. 57-74193; addition of a hydrazine series in JP-A No. 61-154989; addition of a hindered amine type anti-oxidant in JP-A No. 61-146591; addition of a nitrogen containing. heterocyclic mercapto type compound in JP-A No. 61-177279; addition of a thioether type anti-oxidant in JP-A Nos. 1-115677 and 1-35479; addition of a hindered phenol type anti-oxidant having a specific structure in JP-A No. 1-36480; addition of a hindered phenol type anti-oxidant and a hindered amine type anti-oxidant in combination in JP-A No. 3-13376; addition of an ascorbic acid series in JP-A Nos. 7-195824 and 8-150773; addition of zinc sulfate in JP-A No. 7-149037; incorporation of a thiocyanate series in JP-A No. 7-314882; addition of a thiourea derivative in JP-A No. 7-314882; incorporation of a saccharide in JP-A Nos. 7-276790 and 8-108617; addition of a phosphoric acid type anti-oxidant in JP-A No. 8-118791; addition of such as a nitrite, a sulfite and a thiosulfite in JP-A No. 8-300807; and addition of a hydroxyl amine derivative in JP-A No. 9-267544.

However, in an ink jet recording sheet provided with tiny pores, the effect can hardly be said to be sufficient, and there is a problem in that ink absorbability of a porous layer is decreased when a large amount of such various anti-fading agents are added to achieve a sufficient anti-fading effect.

Further, in the case of utilizing water-soluble dye ink, problems such as disadvantages of generated bleeding and of poor water resistance exist, due to high hydrophilic characteristics. That is to say, dyes tend to bleed when stored under high humidity over a long duration after recording or if water drops are accidentally dripped onto a printed surface. To overcome this problem, it is a general practice that a dye fixing substance such as a cationic substance is added to the pore layer. For example, preferably utilized has been a method in which a cation polymer is utilized and which combined with an anionic ink dye to firmly immobilize the dye. Such cationic polymers include a polymer having a quaternary ammonium group, such as described, for example, in "Technologies and Materials for Ink jet Printer" (published by CMC Co., Ltd., July 1998) and the literature in paragraph [0008] of JP-A No. 9-193532. Further, a method, in which a water-soluble polyvalent metal ion is added into an ink jet recording sheet in advance on which dyes are immobilized by coagulating adhesion at the time of ink jet recording, is also proposed. Some reduction of bleeding and improvement of water-resistance are observed by use of a cationic polymer or a polyvalent metal ion, however, it is often the case that the effect cannot be exhibited sufficiently even with addition of aforementioned anti-fading agents having negligible diffusibility in an ink absorbing layer, because dye is unevenly distributed in an ink absorbing layer by bonding with a cationic polymer or a polyvalent metal ion.

On the other hand, it is known that resin having an unsaturated bond in a molecule such as butadiene rubber can be utilized in an ink jet recording sheet. For example, a method effectively utilizing resin mainly to absorb a solvent of oil-soluble ink is disclosed (refer to, for example, patent literature 1-6). Further, a utilization method, in which an absorbability of water-based ink is improved by sulfonation of a dien-type polymer or of a hydrogenation adduct thereof to be made hydrophilic, is disclosed, however, it has not been known heretofore that storage stability can be improved by use of a compound having an unsaturated bond in a tiny pore ink absorbing layer.

RELATED ARTS

Patent Document 1
JP-A No. 2000-177234
Patent Document 2
JP-A No. 2000-238407
Patent Document 3
JP-A No. 2001-205929
Patent Document 4
JP-A No. 11-165460
Patent Document 5
JP-A No. 11-99742
Patent Document 6
WO No. 00/41890

SUMMARY OF THE INVENTION

An objective of this invention is to provide an ink jet recording sheet for water-based ink which exhibits superior ink absorbability, capability of recording a high quality image, equal to photographic image quality, having high color density and high image visibility, as well as excellent storage stability.

The invention and its embodiments are described.

An ink jet recording sheet comprising a porous ink receiving layer and a support wherein the porous ink receiving layer contains a compound having a plural number of non-aromatic carbon-carbon unsaturated bonds in a molecule, inorganic particles and a hydrophilic binder.

An ink jet recording method wherein water-based ink is jetted to an ink jet recording sheet comprising a porous ink receiving layer and a support, wherein the porous ink receiving layer containing a compound having a plural number of non-aromatic carbon-carbon unsaturated bonds in a molecule, inorganic particles and a hydrophilic binder.

The hydrophilic binder is preferably cross-linked.

A preferable example of the compound having a plural number of non-aromatic carbon-carbon unsaturated bonds in a molecule is a polymer comprised of butadiene monomer.

The more preferable example of the compound having a plural number of non-aromatic carbon-carbon unsaturated bonds in a molecule is polybutadiene having a number average molecular weight of 500-10,000.

The preferable example of the inorganic particles is silica particles having a mean particle diameter of 3-200 nm.

A weight ratio of the inorganic particles to the hydrophilic binder is preferably from 3:1 to 10:1.

The porous ink receiving layer preferably contains a cationic polymer.

The porous ink receiving layer preferably contains a polyvalent metal salt.

DETAILED DESCRIPTION OF THE INVENTION

In an ink jet recording sheet of this invention, storage stability of a dye is improved by incorporating in a porous ink receiving layer cross-linked binder and a compound having a plural number of carbon-carbon unsaturated bonds in a molecule and fading by an oxidizing gas, especially by ozone gas, of water-based dye ink, which has been a problem with respect to a porous ink receiving layer, is greatly reduced. The reason for this improvement in storage stability is not totally clear, however, it is assumed that a carbon-carbon unsaturated bond provides suitable reactivity in ambient oxidizing gas to prevent fading of a dye. For example, it is known that deterioration of rubber type resin increases by an unsaturated bond as a reactive group and is induced by oxygen, ozone, a radical or a peroxide. To prevent the deterioration of rubber, a hindered phenol series, an amine series, a sulfur-containing compound or a phosphor-containing compound is utilized as an anti-oxidant, and these anti-oxidants have been applied to an ink jet recording sheet as an anti-fading agent of a dye as described above. However, these anti-oxidants are utilized as an anti-degradation agent for resin due to the still higher reactivity than an unsaturated bond of rubber type resins which are known to have a high reactivity, and are tend to be influenced by an ambient oxidizing gas; therefore it is assumed that a continuous effect is rarely obtained due to rapid consumption of said anti-oxidant in a porous-type ink jet recording sheet provided with minute pores in an ink absorbing layer. An unsaturated bond such as that present in rubber resin is highly reactive compared to a dye with an oxidizing gas and has an anti-fading effect, however, it is assumed to have a longer lasting and better anti-fading ability because it is more stable than the above-mentioned anti-oxidants.

The invention will be further detailed below.

A recording sheet of the invention is suitably utilized as a recording sheet for water-based dye ink. Water-based dye ink is ink which utilizes a water-soluble dye or a water-dispersible dye as a colorant, and is comprised of water as an ink solvent or a mixture of water and an organic solvent highly miscible with water. As dyes, typically utilized are acid dyes, direct dyes and basic dyes, of which water solubility is improved by introducing a sulfo group or a carboxy group into dyes such as azo type dyes, xanthene type dyes, phthalocyanine type dyes, quinone type dyes and anthraquinone type dyes. Further, water-based dispersion dye ink, in which dispersion dyes of low water solubility are stably dispersed in a water-based solvent, can also be utilized. As an ink solvent, water or an organic solvent highly miscible with water can be utilized alone or in combination. Specifically, it includes alcohol type solvents such as ethanol, 2-propanol, ethylene glycol, propylene glycol, glycerin, 1,2-hexane diol, 1,6-hexane diol, diethylene glycol monomethylether and tetraethylene glycol monomethylether; amide series such as 2-pyrrolidinone, N-methyl pyrrolidone and N,N-dimethyl acetamido; amine series such as triethanol amine, N-ethyl morpholine and triethylene tetramine; sulfolane, dimethyl sulfoxide, urea, acetonitrile, acetone, etc., and these solvents may be utilized alone or in combination.

An ink jet recording sheet of this invention comprises a support and an ink receiving layer, which is a porous layer and comprises a cross-linked hydrophilic binder, inorganic particles, and further the compound having a plural number of non-aromatic carbon-carbon unsaturated bonds in a molecule. The inorganic particles are preferably employed since high gloss and high color density can be obtained, and, further, minute particles can easily be obtained. Example of the inorganic particles includes, white pigments such as light calcium carbonate, heavy calcium carbonate, magnesium carbonate, kaolin, clay, talc, calcium sulfate, barium sulfate, titanium dioxide, zinc oxide, zinc hydroxide, zinc sulfide, zinc carbonate, hydrotalcite, aluminum silicate, diatomaceous earth, calcium silicate, magnesium silicate, synthesized amorphous silica, colloidal silica, alumina, colloidal alumina, pseudo-boehmite, aluminum hydroxide, lithopone, zeolite and magnesium hydroxide. The above-described inorganic particles can be utilized either as primary particles themselves or in the form of secondary particles.

In this invention, in view of obtaining a high quality print by means of an ink jet recording sheet, as an inorganic particle, silica or alumina is preferable, further compounds such as alumina, pseudo-boehmite, colloidal silica or fine particle silica synthesized by an air phase method, are preferable, and minute particle silica synthesized by an air phase method is specifically preferable. Silica synthesized by an air phase method may be that the surface of which is modified with aluminum. The content of aluminum synthesized by an air phase method the surface of which is modified by aluminum is preferably from 0.05 to 5.0% based on the weight ratio compared to silica.

Any reasonable particle diameter of an inorganic particle may be utilized, however a mean particle diameter of not more than 1 μm is preferable. It is preferably not more than 200 nm to obtain satisfactory glossiness or color density. It is most preferably not more than 100 nm. It is generally preferably not less than 3 nm and specifically not less than 5 nm, in respect to manufacturing of such inorganic particle.

The mean particle diameter of the inorganic particle is determined by observing a cross-section or the surface of a porous layer through an electron-microscope to measure the particle diameter of 100 random particles, and is obtained as a simple averaged value (number average) thereof. Herein, each particle diameter is represented by a diameter of a supposed equivalent projected circle.

Inorganic particles may be present either as a primary particle as it is, or as a secondary or a high dimensionally coagulated particle in a porous layer, however the mean particle diameter represents those forming independent particles in a porous layer when observed through an electron-microscope.

The mean primary particle diameter of inorganic particles is preferably not more than a mean particle diameter observed in a porous layer, while a primary particle diameter of the inorganic particle is preferably not more than 100 nm, more preferably not more than 30 nm and most preferably from 4 to 20 nm, of the minute particles.

The porous layer is formed by applying water-based composition comprising the inorganic particles and the hydrophilic binder. Inorganic particles are required to have sufficient ink absorbability as well as the ability to form an ink absorbing layer with little cracking and the like in the ink receiving layer, and the amount in an ink receiving layer is preferably 5-50 g/m$^2$, while, it is specifically preferably 10-25 g/m$^2$. The content of inorganic particles in the water-based composition is commonly 5-40 weight % and specifically preferably 7-30 weight %.

Examples of the hydrophilic binders are gelatin, polyvinyl pyrrolidone, polyethylene oxide, polyacryl amide and polyvinyl alcohol can all be utilized, while polyvinyl alcohol is specifically preferable.

Polyvinyl alcohol interacts with an inorganic particle and exhibits especially strong power of retaining an inorganic particle; in addition, it is a polymer featuring a hydroscopic property with relatively minor dependence on humidity and exhibits superior resistance against cracking during drying after coating due to a relatively minimal shrinking stress while drying after coating. Polyvinyl alcohol preferably utilized in this invention includes ordinary polyvinyl alcohol prepared by hydrolysis of polyvinyl acetate, as well as modified polyvinyl alcohol such as polyvinyl alcohol the end groups of which are cation modified and anion modified polyvinyl alcohol having an anionic group.

The average degree of polymerization of polyvinyl alcohol which is prepared by hydrolyzing vinyl acetate is preferably at least 300, and is more preferably from 1,000 to 5,000. Further, the saponification ratio is preferably from 70 to 100 percent, and is more preferably 80 to 99.5 percent.

Said cation modified polyvinyl alcohol refers to one which has a primary, secondary or tertiary amino group or a quaternary ammonium group in the main chain or the side chain, as described in, for example, JP-A No. 61-10483, and is prepared by hydrolyzing a copolymer of ethylenic unsaturated monomer having a cationic group with vinyl acetate.

Listed as ethylenic unsaturated monomers having a cationic group are, for example, trimethyl-(2-acrylamido-2,2-dimethylethyl)ammonium chloride, trimethyl-(3-acrylamido-3,3-dimethylpropyl)ammonium chloride, N-vinylimidazole, N-methylvinylimidazole, N-(3-dimethylaminopropyl)methacrylamide, hydroxyethyltrimethylammonium chloride, trimethyl-(2-methacrylamidopropyl)ammonium chloride, and trimethyl-(3-methacrylamidopropyl) ammonium chloride.

The ratio of the cation modified group containing monomers of cation modified polyvinyl alcohol is typically from 0.1 to 10.0 mol percent with respect to vinyl acetate, and is preferably from 0.2 to 5.0 mol percent.

Listed as anion modified polyvinyl alcohols are polyvinyl alcohol having an anionic group, as described in, for example JP-A No. 1-206088, copolymers of vinyl alcohol with vinyl compounds having a water-soluble group, as described in JP-A Nos. 61-237681 and 63-3079799, and modified polyvinyl alcohol having a water soluble group, as described in JP-A No. 7-285265.

Further, listed as nonion modified polyvinyl alcohol are polyvinyl alcohol derivatives which are prepared by adding a polyalkylene oxide group to a part of polyvinyl alcohol, as described in, for example, JP-A No. 7-9758, and block copolymers of vinyl compounds having a hydrophobic group with vinyl alcohol, as described in, for example, JP-A No. 8-25795.

Polyvinyl alcohol may be utilized in combinations of two or more kinds, of differing polymerization degrees or differing kinds of modification. Particularly, in case of utilizing polyvinyl alcohol having a polymerization degree of at least 2,000, it is preferable to add, in advance, polyvinyl alcohol having a polymerization degree of at least 2,000 after addition of the polyvinyl alcohol having a polymerization degree of at least 500, in an amount of 0.05-10 weight % and preferably of 0.1-5.0 weight %, based on an inorganic particle, to prevent significant viscosity increase.

The weight ratio of an inorganic particle to a hydrophilic binder in a porous layer is preferably 2-20. When the weight ratio is more than 2, a porous layer having a sufficient pore ratio can be prepared and a sufficient pore volume can be easily obtained, which prevents clogging of pores by swelling of a hydrophilic binder at the time of ink jet recording, which becomes a factor in maintaining a high ink absorption. On the other hand, when the ratio is less than 20, cracks are rarely generated when the porous layer is heavily coated. A specifically preferable ratio of an inorganic particle to a hydrophilic binder is 2.5 to 12.0 and most preferable is 3-10 by weight.

A compound having a plural number of non-aromatic carbon-carbon unsaturated bonds in a molecule is a compound having at least two ethylenic double linkages or acetylenic triple linkages in a molecule. The effect on storage stability of a dye is assumed to be caused by a portion of a non-aromatic carbon-carbon unsaturated bond. Addition of a large amount of a dye stabilizer into an ink jet recording sheet having a porous ink absorbing layer may close pores to decrease pore volume of the porous ink absorbing layer, and thus therefore is not preferable with respect to ink absorbability. Therefore, a dye stabilizer is required to have a satisfactory effect on dye stabilization at a smaller addition amount. Further, a dye stabilizer added is also necessary to stably remain in a porous layer. For example, even with compounds having non-aromatic carbon-carbon unsaturated bonds in a molecule, those having a relatively low molecular weight such as ethylene or allyl alcohol cannot stably remain in a porous layer due to excessive volatility. To decrease volatility, it is necessary to increase a molecular weight or to introduce a high polarity substituent, however, simply increasing a molecular weight decreases a ratio of an unsaturated bond per unit weight to cause a decrease of pore volume again, which is not preferable. Therefore, it is important to provide a plural number of non-aromatic carbon-carbon unsaturated bonds in a molecule to not decrease the ratio of unsaturated bonds per unit weight even with decreased volatility. On the other hand, a dye fixed in a porous layer by for example a cationic polymer, is fixed in a certain portion of the porous layer. At the extreme, only portions neighboring the outermost surface of a porous layer are dyed. To efficiently increase storage stability of a dye in such a state, it is desirable that a dye stabilizer itself can be diffused to some extent in a porous layer to always be present in the vicinity of a fixed dye molecule. That is to say, the outermost surface of a porous layer is where contact with ambient oxidizing gases is most preferential and neutralization of a dye stabilizer tends to occur relatively rapidly. Even when a dye is localized in the vicinity of the outermost surface by the action of a dye fixing agent, a dye stabilizer can be diffused to the outermost surface from relatively deep within a porous layer, as a highly effective state of dye stabilization, to obtain a highly favorable effect, provided that a dye stabilizer can be diffused to some extent in a porous layer. The factor which determine diffusibility of a compound having a plural number of non-aromatic carbon-carbon unsaturated bonds cannot be determined specifically, however, molecular weight is preferably not overly high, and even with those having a high molecular weight such as a polymer, the number average molecular weight is preferably less than 100,000 and more preferably 500-10,000. In case of a low molecular weight, the boiling point is preferably at least 200° C. and more preferably at least 300° C. Further, compounds of a liquid state or those which easily become a liquid state by being dissolved in water or an ink solvent are preferred in respect to diffusibility.

Specific examples of a compound having a plural number of non-aromatic carbon-carbon unsaturated bonds in a molecule include resin of polymerized butadiene or butadiene copolymerized with other polymerizing monomers; resin such as diallyl phthalate resin, unsaturated polyester resin, furan resin, C5 petroleum resin, terpene resin and cyclopentadiene type resin; monomers having a plural number of polymerizing groups such as diallyl phthalate, triallyloxy-1,3,5-triazine pentaerythritol tetra(meth)acrylate, trimethylolpropane tri(meth)acrylate and divinyl benzene, used as they are or polymerized compounds thereof; unsaturated aliphatic acids such as linoleic acid, linolenic acid and arachidonic acid, or esterified compounds thereof.

Among these, as those having a high ratio of non-aromatic carbon-carbon unsaturated bonds per unit weight, non-water-soluble polymers are preferable and a polymer of butadiene is specifically preferably utilized. To control affinity to an ink solvent and viscosity of resin, preferable is polybutadiene the end groups of which are modified with for example a hydroxyl group, a glycidyl group, an amino group or maleic anhydride, or polybutadiene copolymerized with such as styrene, acrylonitrile and (meth)acrylic acid ester. Such polybutadiene is readily available on the market, under product series names of, for example, Nisso PB (manufactured by Nippon Soda Co., Ltd.), Nisseki Polybutadiene (manufactured by Shin-Nippon Petrochemicals Co., Ltd.), Poly-bd (manufactured by Idemitsu Petrochemical Co., Ltd.), Hycar (manufactured by Ube Industries, Co., Ltd.), Polyoil (manufactured by Nippon Zeon Corporation.) and JSR RB (manufactured by JSR Co., Ltd.).

As an addition method of compounds having non-aromatic carbon-carbon unsaturated bonds in a molecule, into a porous ink receiving layer, they may be added in a coating solution to form an ink absorbing layer, or it may be supplied by means of an over-coating method to an ink receiving layer once a porous layer has been applied, particularly after coating and drying thereof. In case of addition in a coating solution as in the former case, a method in which the compound is added by being homogeneously dissolved in water, an organic solvent or a mixed solvent thereof, or a method in which the compound is added by being dispersed as minute oil droplets (particles) by means of emulsion dispersion, or a wet crushing method can be applied. At the time of emulsion dispersion, a high boiling point solvent may be added appropriately. When an ink receiving layer is constituted of plural layers, the compound may be added in the coating solutions of only one layer, of at least two layers or of all of the constituting layers.

Further, in the case of compounds having non-aromatic carbon-carbon bonds in a molecule are added by means of an over-coating method once a porous ink receiving layer having been prepared, the compounds are preferably applied onto an ink receiving layer after having been homogeneously dissolved in a solvent.

The addition amount, into a porous ink receiving layer of a compound having non-aromatic carbon-carbon bonds in a molecule, is preferably 0.01-3.0 g/m$^2$ of recording sheet. When it is less than 3.0 g, clogging of pores in a porous layer by said compound is depressed to results in high ink absorbability. Further, when it is at least 0.01 g, the effect of this invention can be sufficiently exhibited. In this respect, it is more preferably utilized 0.1-2.0 g/m$^2$ of recording sheet.

Cationic Polymer

In order to minimize the bleeding of images during storage after recording, cationic polymers are preferably employed. The cationic polymers are employed in the ink receiving layer.

Cited as examples of cationic polymers may be polyethyleneimine, polyallylamine, polyvinyl amine, dicyandiamide polyalkylene polyamine condensation products, polyalkylene polyamine dicyandiamide ammonium salt condensation products, dicyandiamide formalin condensation products, epichlorohydrin-dialkylamine condensation products, diallyldimethylammonium chloride polymers, diallyldimethylammonium chloride-$SO_2$ copolymers, polyvinylimidazole, vinylpyrrolidone-vinylimidazole copolymers, polyvinylpyridine, polyamidine, chitosan, cationized starch, vinylbenzyltrimethylammonium chloride copolymers, (2-methacroyloxyethyl)trimethylammonium chloride copolymers, and dimethylaminoethyl methacrylate copolymers.

Further, listed as said polymers are cationic polymers described in "Kagaku Kogyo Jiho (Chemical Industry Update)", Aug. 15 and 25, 1998, and polymer dye fixing agents described in "Kobunshi Yakuzai Nyumon (Introduction to Polymer Pharmaceuticals)", published by Sanyo Kasei Kogyo Co., Ltd.

The cationic polymer can be incorporated in the porous ink receiving layer in such a way in which the cationic polymer is incorporated in a coating composition to form the porous ink receiving layer or the cationic polymer is coated over the formed porous ink receiving layer before drying. In the former instance the cationic polymer may be incorporated directly in the coating compound, or it may be mixed with inorganic particles in advance and then they are incorporated in the coating composition. The inorganic particles and the cationic polymer may form composite particles in such a way in which cationic polymer is mixed with the inorganic particles to prepare absorbed particles, the absorbed particles are coagulated to form a larger size of particles, or the large size particles are pulverized to form particles having uniform size by a mechanical force. In the latter instance the coating composition containing the cationic polymer can be applied by an overcoat coating, curtain coating spray coating and so on.

While the cationic polymer is generally water-soluble since it has a water-soluble group, there is rarely non- or hard-soluble polymer in water. Though water soluble one is preferably employed in view of easy preparation process, hard soluble one can be employed by dissolving in a water miscible organic solvent. The examples of the water miscible organic solvents are those dissolve in water of 10% or more and include alcohols such as methanol, ethanol, isopropanol and n-propanol; glycols such as ethylene glycol, diethylene glycol and glycerin; esters such as ethylacetate and propylacetate; ketones such as acetone and methylethyl ketone; amides such as N,N-dimethylformamide. The organic solvent is employed in an amount of not more than the amount of water.

The cationic polymer is employed in an amount of, preferably, 0.1-10 g/m$^2$ of the ink jet recording sheet, and more preferably 2-5 g/m$^2$ g.

<Polyvalent Metal>

Further, an ink jet recording sheet of this invention preferably contains a polyvalent metal ion to improve water-resistance and humidity-resistance of images. Polyvalent metal ions are not particularly limited provided that they are metal ions having at least divalent, and, preferable polyvalent metals ions include such as aluminum ions, zirconium ions and titanium ions.

These poly-valent metal ions may be incorporated in the ink acceptable layer in a form of a water soluble or water insoluble salt.

Listed as specific examples of aluminum atom containing compounds which are usable in the present invention are aluminum fluoride, hexafluoroaluminate (for example, potassium salts), aluminum chloride, basic aluminum chloride (for example, polyaluminum chloride), tetrachloroaluminate (for example, sodium salts), aluminum bromide, tetrabromoaluminate (for example, potassium salts), aluminum iodide, aluminate (for example, sodium salts, potassium salts, and calcium salts), aluminum chlorate, aluminum perchlorate, aluminum thiocyanate, aluminum sulfate, basic aluminum sulfate, aluminum sulfate potassium (alum), ammonium aluminum sulfate (ammonium alum), sodium sulfate aluminum, aluminum phosphate, aluminum nitrate, aluminum hydrogenphosphate, aluminum carbonate, polyaluminum sulfate silicate, aluminum formate, aluminum acetate, aluminum lactate, aluminum oxalate, aluminum isopropionate, aluminum butyrate, ethyl acetate aluminum diisopropionate, aluminum tris(acetylacetonate), aluminum tris(ethylacetoacetate), and aluminum monoacetylacetonate bis(ethylacetoacetate).

Of these, preferred are aluminum chloride, basic aluminum chloride, aluminum sulfate, basic aluminum sulfate, and basic aluminum sulfate silicate.

Listed as specific examples of zirconium ion containing compounds which are usable in the present invention are zirconium difluoride, zirconium trifluoride, zirconium tetrafluoride, hexafluorozirconate (for example, potassium salts), heptafluorozirconate (for example, sodium salts, potassium salts, and ammonium salts), octafluorozirconate (for example, lithium salts), zirconium fluoride oxide, zirconium dichloride, zirconium trichloride, zirconium tetrachloride, hexachlorozirconate (for example, sodium salts and potassium salts), zirconium oxychloride (zirconyl chloride), zirconium dibromide, zirconium tribromide, zirconium tetrabromide, zirconium bromide oxide, zirconium triiodide, zirconium tetraiodide, zirconium peroxide, zirconium hydroxide, zirconium sulfide, zirconium sulfate, zirconium p-toluenesulfonate, zirconyl sulfate, sodium zirconyl sulfate, acidic zirconyl sulfate trihydrate, potassium zirconyl sulfate, zirconium selenate, zirconium nitrate, zirconyl nitrate, zirconium phosphate, zirconium carbonate, ammonium zirconyl carbonate, zirconium acetate, zirconyl acetate, ammonium zirconyl acetate, zirconyl lactate, zirconyl citrate, zirconyl stearate, zirconium phosphate, zirconyl phosphate, zirconium oxalate, zirconium isopropionate, zirconium butyrate, zirconium acetylacetonate, acetyl acetone zirconium butyrate, zirconium stearate butyrate, zirconium acetate, and bis(acetylacetonato)dichlorozirconium, and tris (acetylacetonato)chlorozirconium.

Of these compounds containing a zirconium atom, preferred are compounds which can be stably incorporated to the coating solution for ink absorptive layer. More specifically, preferred are; zirconyl carbonate, ammonium zirconyl carbonate, zirconyl acetate, zirconyl nitrate, zirconium oxychloride, zirconium lactate, and zirconyl citrate. Most preferred are ammonium zirconyl carbonate and zirconyl acetate.

In cases of incorporating a compound containing polyvalent metal ions into a coating solution to form an ink absorbing layer, applied can be a method in which the compound is added by being homogeneously dissolved in water, an organic solvent or a mixed solvent thereof or a method in which the compound is added by being dispersed as minute particles by means of a wet crushing method via such as a sand mill or emulsion dispersion. When an ink receiving layer is constituted of plural layers, the compound may be added in the coating solutions of only one layer, of at least two layers or of all of the constituting layers. Further, in case of a compound containing polyvalent metal ions being added by means of an over-coating method once a porous ink receiving layer having been prepared, the compound is preferably supplied on an ink receiving layer after having been homogeneously dissolved in a solvent.

The used amount of said compounds containing a zirconium atom or an aluminum atom is generally 0.05 to 20 mili mol per m$^2$ of the ink jet recording sheet, is preferably 0.1 to 10 mili mol per m$^2$.

The hydrophilic binder resin of the porous ink receiving layer is preferably cross-linked. One of the objectives of this invention is to improve storage stability of image formed by water-based dye ink. The water-base ink may make the hydrophilic binder swollen, whereby ink absorbing speed lowers and mottle or streak defect of the image may be sometimes induced to deteriorate image quality. Swelling is restrained by cross-linking of the binder resin, and high quality image can be obtained.

For making the binder cross-linked such methods are employed as a method employing a hardener of the hydrophilic binder, a method employing a hydrophilic binder having cross-linking group, a method employing a hydrophilic binder having a cross-linking group by an actinic ray and thereafter light exposing the coating, a method cross-linking by electron beam. The simplest way is a method employing the hardener.

It is preferable that hardeners of the water soluble binder to form a porous ink receiving layer be incorporated into the ink jet recording sheet of the present invention.

Hardener

Said hardeners are generally compounds which have a group capable of reacting with said hydrophilic binders, or compounds which promote reaction between different groups of said hydrophilic binders. They are suitably selected and employed depending on the type of hydrophilic binders. Further listed as specific examples of hardeners are, for example, epoxy based hardeners (diglycidyl ethyl ether, ethylene glycol diglycidyl ether, 1,4-butanediol diglycidyl ether, 1,6-diglycidylcyclohexane, N,N-glycidyl-4-glycidylpxyaniline, sorbitol polyglycidyl ether, and glycerol polyglycidyl ether), aldehyde based hardeners (formaldehyde and glyoxal), active halogen based hardeners (2,4-dichloro-4-hydroxy-1,3,5-s-trizine, and bisvinylsulfonyl methyl ether), boric acid and salts thereof, borax, and aluminum alum.

Boric acid or salts thereof refer to oxygen acid having a boron atom as the central atom and salts thereof, and specifically include orthoboric acid, diboric acid, metaboric acid, tetraboric acid, pentaboric acid, and octaboric acid, and salts thereof.

As a hardener, boric acid and salts thereof containing a boron atom may be utilized, as an aqueous solution alone or a mixture of two or more kinds. Specifically preferable is a mixed aqueous solution of boric acid and borax.

Each aqueous solution of boric acid and borax may be added only as a relatively dilute aqueous solution, however, it is possible to prepare a condensed aqueous solution by mixing both compounds to make a concentrated coating solution. Further, it is advantageous that pH of the aqueous solution to be added can be controlled relatively easily.

The amount to be used is preferably from 1 to 600 mg, and is preferably from 100 to 600 mg per g of the hydrophilic binder.

Support

Supports suitably employed in the present invention may be water-absorptive supports but are preferably non-water-absorptive supports.

Listed as water-absorptive supports capable of being employed in the present invention may be, for example, common paper, cloth, and sheets and boards comprised of wood. Of these, paper is particularly preferred due to the excellent water absorbability of the base material itself, and low cost. Employed as paper supports may be those which are prepared by employing, as the main raw materials, wood pulp such as chemical pulp such as LBKP and NBKP, mechanical pulp such as GP, CGP, RMP, TMP, CTMP, CMP, and PGW, and waste paper pulp such as DIP. Further, if desired, suitably employed as raw materials may be various types of fibrous materials such as synthetic pulp, synthetic fibers, and inorganic fibers.

If necessary, various types of additives such as sizing agents, pigments, paper strength enhancing agents, fixing agents, optical brightening agents, wet paper strengthening agents, and cationic agents, may be incorporated into said paper supports.

It is possible to produce paper supports as follows. Fibrous materials such as wood pulp and various additives are blended and the resulting blend is applied to any of the various paper making machines such as a Fourdrinier paper machine, a cylinder paper machine, and a twin wire paper machine. Further, if necessary, it is possible to carry out a size press treatment employing starch and polyvinyl alcohol, various coating treatments, and calender finishing during paper making processes or in said paper making machine.

Non-water-absorptive supports capable of being preferably employed in the present invention include transparent supports as well as opaque supports. Listed as said transparent supports are films comprised of materials such as polyester resins, diacetate resins, triacetate resins, acrylic based resins, polycarbonate based resins, polyvinyl chloride based resins, and polyimide based resins, cellophane, and celluloid. Of these, when employed for Overhead Projectors, those, which are radiation heat resistant, are preferred, and polyethylene terephthalate is particularly preferred. The thickness of said transparent supports is preferably from 50 to 200 μm.

Preferred as said opaque supports are, for example, resin coated paper (being so-called RC paper) in which at least one surface of the base paper is covered with a polyolefin resin layer comprised of white pigment, and so-called white PET prepared by incorporating white pigments such as barium sulfate into said polyethylene terephthalate.

For the purpose of enhancing the adhesion between said various supports and the ink receiving layer, it is preferable that prior to coating said ink receiving layer, said supports are subjected to a corona discharge treatment, as well as a subbing treatment. Further, the ink jet recording sheets of the present invention are not necessary to be white and may be tinted.

It is particularly preferable that employed as the ink jet recording sheets of the present invention be polyethylene laminated paper supports because recorded images approach conventional photographic image quality, and high quality images are obtained at relatively low cost. Said polyethylene laminated paper supports will now be described.

Base paper, employed in said paper supports, are made employing wood pulp as the main raw material, if necessary, together with synthetic pulp such as polypropylene and synthetic fiber such as nylon and polyester. Employed as said wood pulp may be any of LBKB, LBSP, NBKP, NBSP, LDP, NDP, LUKP, or NUKP. It is preferable that LBKP, NBSP, LBSP, NDP, and LDP, which are comprised of shorter fiber, are employed in a greater amount. However, the ratio of LBSP and/or LDP is preferably from 10 to 70 percent by weight.

Preferably employed as said pulp is chemical pulp (sulfate pulp and sulfite pulp). Further, also useful is pulp which has been subjected to a bleach treatment to increase its whiteness.

Into said base paper suitably incorporated may be sizing agents such as higher fatty acids and alkylketene dimers; white pigments such as calcium carbonate, talc, and titanium oxide; paper strength enhancing agents such as starch, polyacrylamide, and polyvinyl alcohol; optical brightening agent; moisture maintaining agents such as polyethylene glycols; dispersing agents; and softeners such as quaternary ammonium salts.

The degree of water freeness of pulp employed for paper making is preferably from 200 to 500 ml under CSF Specification. Further, the sum of weight percent of 24-mesh residue and weight percent of 42-mesh calculated portion regarding the fiber length after beating, specified in JIS-P-8207, is preferably between 30 and 70 percent. Further, the weight percent of 4-mesh residue is preferably 20 percent by weight or less.

The weight of said base paper is preferably from 30 to 250 $g/m^2$ and is most preferably from 50 to 200 $g/m^2$. The thickness of said base paper is preferably from 40 to 250 μm.

During the paper making stage or after paper making, said base paper may be subjected to a calendering treatment to result in excellent smoothness. The density of said base paper is generally from 0.7 to 1.2 $g/cm^3$ (JIS-P-8118) Further, the stiffness-of said base paper is preferably from 20 to 200 g under the conditions specified in JIS-P-8143.

Surface sizing agents may be applied onto the base paper surface. Employed as said surface sizing agents may be the same as those above, capable of being incorporated into said base paper.

The pH of said base paper, when determined employing a hot water extraction method specified in JIS-P-8113, is preferably from 5 to 9.

Polyethylene, which is employed to laminate both surfaces of said base paper, is mainly comprised of low density polyethylene (LDPE) and/or high density polyethylene (HDPE). Other LLDPE or polypropylene may be partially employed.

Specifically, as is generally done with photographic paper, the polyethylene layer located on the ink receiving layer side is preferably constituted employing polyethylene into which rutile or anatase type titanium oxide is incorporated so that opacity as well as whiteness is improved. The content ratio of said titanium oxide is generally from 3 to 20 percent by weight with respect to polyethylene, and is more preferably from 4 to 13 percent by weight.

It is possible to employ said polyethylene coated paper as glossy paper. Further, in the present invention, it is possible to employ polyethylene coated paper with a matt or silk surface, as obtained in the conventional photographic paper, by carrying out an embossing treatment during extrusion coating of polyethylene onto said base paper.

In said polyethylene coated paper, it is preferable to maintain paper moisture content of 3 to 10 percent by weight. Additive In addition to said additives, various other additives may be incorporated into the ink receiving layer, as well as other layers which may be desired for the ink recording sheet of the present invention. The following various types of additives cited as incorporated examples may be: polystyrene, polyacrylic acid esters, polymethacrylic acid esters, polyacrylamides, polyethylene, polypropylene, polyvinyl chloride, polyvinylidene chloride, or copolymers thereof; fine organic latex particles of urea resins or melamine resins; various types of cationic or nonionic surface active agents; UV absorbers described in JP-A Nos. 57-74193, 57-87988, and 62-261476; anti-fading additives described in JP-A Nos. 57-74192, 57-87989, 60-72785, 61-146591, 1-95091, and 3-13376; brightening agents described in JP-A Nos. 59-42993, 59-52689, 62-280069, 61-242871, and 4-219266; pH regulators such as sulfuric acid, phosphoric acid, citric acid, sodium hydroxide, potassium hydroxide, and potassium carbonate; antifoaming agents, antiseptics, thickeners, antistatic agents, and matting agents.

Preparation Method

Preparation method of an ink jet recording medium according to the invention is described.

In the preparation of the ink jet recording medium it is possible to simultaneously apply two or more layers onto said support, and simultaneous coating is particularly preferred in which all hydrophilic binder layers are simultaneously coated. Employed as coating methods are a roll coating method, a rod bar coating method, an air knife coating method, a spray coating method, and a curtain coating method. In addition, preferably employed is the slide bead coating or extrusion coating method employing a hopper, described in U.S. Pat. No. 2,681,294 or U.S. Pat. No. 2,761,791.

When simultaneous multilayer coating is carried out, the viscosity of the coating composition employed for the slide bead coating method is preferably in the range of 5 to 100 mPa·s, and is more preferably in the range of 10 to 50 mPa·s. The viscosity of the coating composition employed for the curtain coating method is preferably in the range of 5 to 1,200 mPa·s, and is more preferably in the range of 25 to 500 mPa·s.

Further, the viscosity of the coating composition at 15° C. is preferably at least 100 mPa·s, is more preferably from 100 to 30,000 mPa·s, still more preferably from 3,000 to 30,000 mPa·s, and is most preferably from 10,000 to 30,000 mPa·s.

The coating and drying method is as follows. Coating compositions are heated to 30° C. and are then subjected to simultaneous multilayer coating. Thereafter, it is preferable that the resultant coating be temporarily cooled to 1 to 15° C. and subsequently dried at more than or equal to 10° C. It is preferable that the coating compositions be prepared, coated, and dried at a temperature lower than or equal to the Tg of the thermoplastic resins so that the thermoplastic resins incorporated in the surface layer are not subjected to filming during the preparation of the coating compositions, as well as during coating and drying. Drying is more preferably carried out under conditions in which the wet bulb temperature is in the range of 5 to 50° C., and the coating surface temperature is in the range of 10 to 50° C. Further, from the viewpoint of achieving uniform coating, it is preferable to use a horizontal setting system as a cooling system immediately after coating.

Further, it is preferable that the production process includes a step which stores the resultant coating at 35 to 70° C. from 24 hours to 60 days.

Heating conditions are not particularly limited as long as conditions are satisfied in which the resultant coating is stored at 35 to 70° C. from 24 hours to 60 days. Preferred examples include 3 days to 4 weeks at 36° C., 2 days to 2 weeks at 40° C., and 1 to 7 days at 55° C. The heating process is capable of enhancing the hardening reaction of hydrophilic binders or the crystallization of hydrophilic binders. As a result, it is possible to achieve desired ink absorbability.

EXAMPLES

In the following, this invention will be explained with reference to examples, however, the invention is not limited to these examples. Herein, "%" in these examples represents weight % unless otherwise noted.

Example 1

<Preparation of Silica Dispersion Solution D-1>

Silica dispersion solution B-1 (at a pH of 2.6, containing 0.5% of ethanol) of 400 L, which had been homogeneously dispersed in advance, containing 25% of gas phase prepared silica (Aerosil 300 manufactured by Nippon Aerosil Co., Ltd.) having a mean primary particle diameter of approximately 0.007 μm were added while stirring at 3000 rpm at room temperature into 110 L of aqueous solution C-1 (at a pH of 2.5, containing 2 g of anti-foaming agent SN-381 manufactured by SAN NOPCO LIMITED) containing 12% of cationic polymer P-1 and 2% of ethanol. Next, 54 L of mixed aqueous solution A-1 of boric acid and borax at a weight ratio of 1/1 (each at a concentration of 3%) were gradually added while stirring.

Next, the solution was dispersed using a high pressure homogenizer available from Sanwa Industries Co., Ltd. at a pressure of 3000 N/cm$^2$ and the total volume was raised to 630 L with pure water to prepare nearly transparent silica dispersion solution D-1.

Cationic Polymer P-1

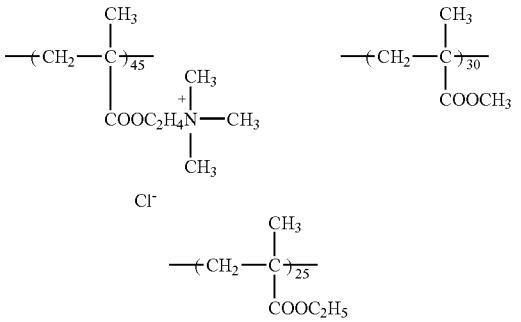

<Preparation of Silica Dispersion Solution D-2>

Silica dispersion solution B-1, described above, of which 400 L were added while stirring at 3000 rpm at room temperature into 120 L of aqueous solution C-2 (pH of 2.5) containing 12% of cationic polymer P-2, 10% of n-propanol and 2% of ethanol, followed by 52 L of mixed aqueous solution A-1, described above, which was also gradually added while stirring. Next, the solution was dispersed by a high pressure homogenizer produced by Sanwa Industries Co., Ltd. at a pressure of 3000 N/cm$^2$ after which the total volume was raised to 630 L with pure water to prepare nearly transparent silica dispersion solution D-2.

Above-described silica dispersion solutions D-1 and D-2 were filtered using a TCP-30 type filter, having a filtering precision of 30 μm, manufactured by Advantec Toyo, Ltd.

Cationic Polymer P-2

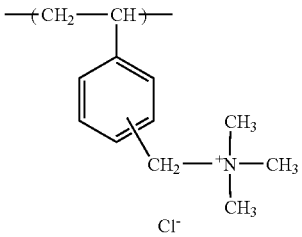

<Preparation of Oil Dispersion Solution-1>

Diisodecyl phthalate of 20 kg and anti-oxidant (AO-1) of 20 kg were dissolved under heat in 45 kg of ethyl acetate, and the resulting solution was mixed with 210 L of an aqueous solution containing 8 kg of acid processed gelatin, 2.9 kg of cationic polymer P-1 and 5 kg of saponin at 55° C., after being dispersed with a high pressure homogenizer, the total volume was raised to 300 L with pure water to prepare oil dispersion solution-1.

Anti-oxidant (AO-1)

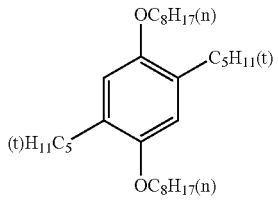

<Preparation of Ink Receiving Layer Coating Solution>

Utilizing each of the above-prepared dispersion solutions, each of the following additives was mixed successively to prepare each coating solution for a porous layer. Herein, each addition amount is represented based on the amount per L of coating solution.

<First Layer Coating Solution: Lowest Layer>

| | |
|---|---|
| Silica dispersion solution D-1 | 580 ml |
| Polyvinyl alcohol (manufactured by Kuraray Co. Ltd.; PVA 203) 10% aqueous solution | 5 ml |
| Polyvinyl alcohol (mean polymerization degree: 3800, at a saponification degree of 88%) 6.5% aqueous solution | 290 ml |
| Oil dispersion solution-1 | 30 ml |
| Latex dispersion solution (AE-803 manufactured by Showa Highpolymer Co., Ltd.) | 42 ml |
| Ethanol | 8.5 ml |

The total volume was raised to 1000 ml with pure water.

<Second Layer Coating Solution>

| | |
|---|---|
| Silica dispersion solution D-1 | 580 ml |
| Polyvinyl alcohol (manufactured by Kuraray Co. Ltd.; PVA 203) 10% aqueous solution | 5 ml |
| Polyvinyl alcohol (a mean polymerization degree: 3800, at a saponification degree of 88%) 6.5% aqueous solution | 270 ml |
| Oil dispersion solution-1 | 20 ml |
| Latex dispersion solution (AE-803 manufactured by Showa Highpolymer Co., Ltd.) | 22 ml |
| Ethanol | 8 ml |

The total volume was raised to 1000 ml with pure water.

<Third Layer Coating Solution>

| | |
|---|---|
| Silica dispersion solution D-2 | 630 ml |
| Polyvinyl alcohol (PVA 203 manufactured by Kuraray Co. Ltd.) 10% aqueous solution | 5 ml |
| Polyvinyl alcohol (a mean polymerization degree: 3800, at a saponification degree of 88%) 6.5% aqueous solution | 270 ml |
| Oil dispersion solution-1 | 10 ml |
| Latex dispersion solution (AE-803 manufactured by Showa Highpolymer Co., Ltd.) | 5 ml |
| Ethanol | 3 ml |

The total volume was raised to 1000 ml with pure water.

<Fourth Layer Coating Solution: Top Layer>

| | |
|---|---|
| Silica dispersion solution D-2 | 660 ml |
| Polyvinyl alcohol (PVA 203 manufactured by Kuraray Co. Ltd.) 10% aqueous solution | 5 ml |
| Polyvinyl alcohol (a mean polymerization degree: 3800, at a saponification degree of 88%) 6.5% aqueous solution | 250 ml |
| Cationic surfactant-1 of 4% aqueous solution | 3 ml |
| Saponin of 25% aqueous solution | 2 ml |
| Ethanol | 3 ml |

The total volume was raised to 1000 ml with pure water.

Cationic Surfactant-1

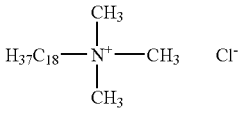

Each coating solution prepared above was filtered using a TCPD-30 filter having a filtration precision of 20 μm manufactured by Advantec Toyo Ltd., followed by being filtered through a TCPD-10 filter.

<Preparation of Recording Sheets>

Next, each coating solution described above was coated employing a slide-hopper type coater at 40° C., by means of simultaneous 4 layer coating, on a paper support (RC paper) both surfaces of which having been coated with polyethylene, to result in the following wet thicknesses.

<Wet Thickness>

First Layer: 42 μm

Second Layer: 39 μm

Third Layer: 44 μm

Fourth Layer: 38 μm

Herein, the following support was wound into a 1.5×4000 m roll and utilized as the above-described RC paper.

Said RC paper was comprised of photographic raw paper having a water-content of 8% and a basis weight of 170 g, the front surface of which was coated to a 35 μm thickness by melt extrusion with polyethylene containing 6% of anatase type titanium oxide, and the back surface of which was coated to a 35 μm thickness by melt extrusion on 40 μm polyethylene. The front surface, after having been corona discharge treated, was coated with an under-coating layer of polyvinyl alcohol at a coating amount of 0.05 g/m$^2$ of recording medium, and the back surface, after having been corona discharge treated, was coated with a backing-coat layer containing approximately 0.4 g of styrene-acrylic acid ester type latex binder having a Tg of approximately 80° C., 0.1 g of an anti-static agent, sodium styrene sulfonate, and as a matting agent, 0.1 g of silica having a mean particle diameter of 2 μm.

After ink receiving layer coating solutions were coated, and the resulting sheet was passed through a cooling zone maintained at 5° C. to lower the film surface temperature down to 13° C. and dried by suitably controlling the temperatures of plural drying zones, followed by being wound into a roll, thereby preparing recording sheet-1.

Recording Sheet-2: Recording sheet-2 was prepared in a similar manner to recording sheet-1, except that the antioxidant (AO-1) was replaced by Poly bd R45HT (manufactured by Idemitsu Petrochemical Co., Ltd.; a number average molecular weight of 2,800) in preparation of "Oil Dispersion Solution-1".

Recording Sheet-3: Recording sheet-3 was prepared in a similar manner to recording sheet-1, except that the antioxidant (AO-1) was replaced by Poly bd R15HT (manufactured by Idemitsu Petrochemical Co., Ltd.; a number average molecular weight of 1,200) in preparation of "Oil Dispersion Solution-1".

Recording Sheet-4: Recording sheet-4 was prepared in a similar manner to recording sheet-1, except that the antioxidant (AO-1) was replaced by Poly oil 130 (manufactured by Nippon Zeon Corporation; a number average molecular weight of 3,000) in preparation of "Oil Dispersion Solution-1".

Recording Sheet-5: Recording sheet-5 was prepared in a similar manner to recording sheet-1, except that the antioxidant (AO-1) was replaced by Poly oil 110 (manufactured by Nippon Zeon Corporation; a number average molecular weight of 1,600) in preparation of "Oil Dispersion Solution-1".

Recording Sheet-6: Recording sheet-6 was prepared in a similar manner to recording sheet-1, except that the antioxidant (AO-1) was replaced by Nisso PB B-1000 (manufactured by Nippon Soda Co., Ltd.; a number average molecular weight of 900-1,300) in preparation of "Oil Dispersion Solution-1".

Recording Sheet-7: Recording sheet-7 was prepared in a similar manner to recording sheet-1, except that the antioxidant (AO-1) was replaced by Nisseki Polybutadiene E-1000-8 (manufactured by Shin-Nippon Petrochemicals Co., Ltd.; a number average molecular weight of approximately 1,000) in preparation of "Oil Dispersion Solution-1".

Recording Sheet-8: Recording sheet-8 was prepared in a similar manner to recording sheet-1, except that the antioxidant (AO-1) was replaced by Daiso DAP S (manufactured by Daiso Co., Ltd.; a weight average molecular weight of approximately 35,000) in preparation of "Oil Dispersion Solution-1".

Recording Sheet-9: Recording sheet-9 was prepared in a similar manner to preparation of recording sheet-1, except that the oil dispersion solution in the 1st-3rd layer coating solutions was replaced by the same amount of modified styrene-butadiene latex LX438C (manufactured by Nippon Zeon Corporation).

Recording Sheet-10: Recording sheet-10 was prepared in a similar manner to preparation of recording sheet-2, except that silica dispersion solution D-1 and silica dispersion solution D-2 were prepared by replacing silica via a gas phase method, which was utilized in preparation of silica dispersion solution B-1, with Aerosil 200 (manufactured by Nippon Aerosil Co., Ltd.).

Recording Sheet-11: Recording sheet-11 was prepared in a similar manner to preparation of recording sheet-2, except that silica dispersion solution D-1 and silica dispersion solution D-2 were prepared by replacing silica via a gas phase method, which was utilized in preparation of silica dispersion solution B-1, with Aerosil 50 (manufactured by Nippon Aerosil Co., Ltd.).

Recording Sheet-12: Recording sheet 12 was prepared in a similar manner to preparation of recording sheet-1, except that the oil dispersion solution was not added in the 1st-3rd layer coating solutions.

Recording Sheet-13: Poly bd R45HT (manufactured by Idemitsu Petrochemical Co., Ltd.; a number average molecular weight of 2,800) was dissolved in ethyl acetate to prepare a 10% solution, and the solution was spray coated on recording sheet-1 to result in 0.5 g/m$^2$ of Poly bd R45HT, followed by being dried to prepare recording sheet-13.

Recording Sheet-14: Recording sheet-14 was prepared in a manner similar to preparation of recording sheet-13, except that Poly bd R45HT was replaced by Poly oil 130 (manufactured by Nippon Zeon Corporation).

Recording Sheet-15: Recording sheet-15 was prepared in a manner similar to preparation of recording sheet-13, except that Poly bd R45HT was replaced by Hycar ATBN1300 X16 (manufactured by Ube Industries, Co., Ltd.; a number average molecular weight of 3,000-3,500).

Recording Sheet-16: Recording sheet-16 was prepared in a manner similar to preparation of recording sheet-13, except that Poly bd R45HT was replaced by JSR RB-810 (manufactured by JSR Co., Ltd.; a weight average molecular weight of 150,000).

Recording Sheet-17: Zircosol ZA (manufactured by Daiichi Kigenso Kagakukogyo Co., Ltd.; an aqueous solution of zirconyl acetate) was diluted with pure water, and the solution was spray coated on recording sheet-2 to results in a coating amount of 0.5 g/m$^2$ of zirconyl acetate, followed by being dried to prepare recording sheet-17.

Thus obtained ink jet recording sheets 1-17 were each evaluated on the following criteria.

<Image Storage Stability>

After recording of a solid cyan image by use of BJ-F870 produced by Canon Inc., recording sheets obtained above were sprayed directly with ambient outdoor air for 1 month, whereby fading of the cyan image was evaluated. Color fading was represented by a residual ratio of the starting density.

<Observed Particle Diameter>

A cross section of a recording layer was observed via an electron-microscope, and particle diameter was determined by means of image analysis.

<Mottled Appearance>

A solid green image was printed by use of Ink jet Printer BJ-F870 produced by Canon Inc., the uniformity of which was observed visually.

A: Completely uniform solid image

B: Uniform appearance at an observation distance of 30 cm

C: Uniform appearance at an observation distance of at least 60 cm

D: Mottled appearance even at an observation distance of at least 60 cm

<Crack>

The coated surface was studied to evaluate the degree of cracking based on the following criteria.

A: Cracks are barely noticeable.

B: A few fine cracks of less than 0.5 mm are noticeable.

C: A few coarse cracks of at least 0.5 mm are observed.

D: Coarse cracks of at least 0.5 mm are observed over the whole image.

<Bleeding>

A fine magenta line (1/300×2.54 cm wide) was printed on a sheet using Ink jet Printer PM900C produced by Seiko Epson Co., Ltd., after storing the sheet under an environment of 23° C. and 80% RH for one week, the increased width ratio of the fine line was determined. All the results of each evaluation are shown in Table 1.

TABLE 1

| | | Color fading (residual %) | Observed particle diameter | Cracking | Mottled appearance | Bleeding |
|---|---|---|---|---|---|---|
| Recording sheet-1 | Comparison | 70% | 65 nm | B | B | 1.05 |
| Recording sheet-2 | Invention | 94% | 64 nm | B | A | 1.04 |
| Recording sheet-3 | Invention | 95% | 63 nm | B | A | 1.04 |
| Recording sheet-4 | Invention | 95% | 63 nm | A | A | 1.03 |
| Recording sheet-5 | Invention | 94% | 64 nm | A | A | 1.03 |
| Recording sheet-6 | Invention | 95% | 64 nm | A | A | 1.03 |
| Recording sheet-7 | Invention | 94% | 65 nm | B | A | 1.04 |
| Recording sheet-8 | Invention | 93% | 66 nm | B | A | 1.04 |
| Recording sheet-9 | Invention | 92% | 65 nm | A | A | 1.04 |
| Recording sheet-10 | Invention | 95% | 90 nm | A | A | 1.03 |
| Recording sheet-11 | Invention | 94% | 150 nm | A | A | 1.05 |
| Recording sheet-12 | Comparison | 65% | 65 nm | C | A | 1.05 |
| Recording sheet-13 | Invention | 95% | 65 nm | A | A | 1.02 |
| Recording sheet-14 | Invention | 97% | 65 nm | A | A | 1.02 |
| Recording sheet-15 | Invention | 98% | 65 nm | A | A | 1.02 |
| Recording sheet-16 | Invention | 97% | 65 nm | A | B | 1.03 |
| Recording sheet-17 | Invention | 95% | 65 nm | A | A | 1.01 |

Referring to Table 1, it is clear that recording sheets of this invention (2-11, and 13-17) compared to comparative recording sheets (1 and 12) were excellent in all characteristics of color fading, cracking, mottling appearance and bleeding to provide overall high quality images.

Having been proved in the examples, a recording sheet for water-based dye ink of this invention improves image storage stability, is excellent in ink absorbability, while capable of forming high quality images without bleeding.

The invention claimed is:

1. An ink jet recording sheet for use with aqueous ink comprising a support having a porous ink receiving layer thereon, wherein the porous ink receiving layer is formed from an aqueous coating solution and comprises inorganic particles, a cross-linked hydrophilic binder and a compound having a plural number of nonaromatic carbon-carbon unsaturated bonds in a molecule, wherein the compound is polybutadiene having a number average molecular weight of 500 to 10,000, the inorganic particles are silica particles having a mean particle diameter of 3 to 200 nm, and the compound having a plural number of nonaromatic carbon-carbon unsaturated bonds in a molecule is added dispersed as minute oil droplets in the aqueous coating solution for forming the porous ink receiving layer.

2. The ink jet recording sheet of claim 1, wherein the weight ratio of the inorganic particles to the hydlrophilic binder is from 3:1 to 10:1.

3. The ink jet recording sheet of claim 1, wherein the porous ink receiving layer contains a cationic polymer.

4. The ink jet recording sheet of claim 1, wherein the porous ink receiving layer contains a polyvalent metal salt.

5. An ink jet recording method comprising jetting water-based ink onto an ink jet recording sheet according to claim 1.

6. The ink jet recording method of claim 5, wherein the weight ratio of the inorganic particles to the hydrophilic binder is from 3:1 to 10:1.

7. The ink jet recording method of claim 5, wherein the porous ink receiving layer contains a cationic polymer.

8. The ink jet recording method of claim 5, wherein the porous ink receiving layer contains a polyvalent metal salt.

* * * * *